United States Patent [19]

Annas et al.

[11] 4,146,290

[45] Mar. 27, 1979

[54] ELECTRICAL CONNECTOR

[75] Inventors: Nick S. Annas, Centralia, Mo.; Charles R. Russ, Pittsburgh, Pa.

[73] Assignee: Aluminum Company of America, Pittsburgh, Pa.

[21] Appl. No.: 827,243

[22] Filed: Aug. 24, 1977

Related U.S. Application Data

[63] Continuation-in-part of Ser. No. 694,296, Jun. 9, 1976, abandoned.

[51] Int. Cl.[2] ..... H01R 11/10

[52] U.S. Cl. ..... 339/95 R; 339/272 R

[58] Field of Search ..... 339/272, 95

[56] References Cited

U.S. PATENT DOCUMENTS

| | | | |
|---|---|---|---|
| 2,201,674 | 5/1940 | Rowe et al. | 339/272 R |
| 2,232,857 | 2/1941 | Jackson | 339/272 UC |
| 2,422,934 | 6/1947 | Stieglitz | 339/272 UC |
| 2,732,535 | 1/1956 | Hammerly | 339/272 UC |
| 2,920,305 | 1/1960 | Gibson et al. | 339/272 R |
| 3,374,456 | 3/1968 | Evans | 339/272 R |

FOREIGN PATENT DOCUMENTS

| | | | |
|---|---|---|---|
| 662149 | 7/1938 | Fed. Rep. of Germany | 339/272 A |
| 851878 | 10/1939 | France | 339/272 R |
| 233001 | 6/1944 | Switzerland | 339/272 UC |
| 1295391 | 11/1972 | United Kingdom | 339/272 R |

*Primary Examiner*—Joseph H. McGlynn
*Attorney, Agent, or Firm*—Elroy Strickland

[57] ABSTRACT

An electrical connector comprising a metal body provided with a bore extending longitudinally therethrough, and at least one opening or window directly intersecting the bore above a base surface of the body. A screw means having a relatively large diameter (in terms of the width and length of the metal body) extends into the body adjacent the opening or window and perpendicular to the axis of the bore. The screw means is effective to place the body portions on opposed sides of the window and the connector in tension when the screw compressibly engages a cable or conductor inserted into the bore against the base surface, and to enhance shear in such a cable or conductor in the general direction of travel of the screw in a controlled manner.

1 Claim, 6 Drawing Figures

ELECTRICAL CONNECTOR

This application is a continuation-in-part of U.S. Ser. No. 694,296, filed June 9, 1976, now abandoned.

BACKGROUND OF THE INVENTION

The present invention relates generally to electrical connectors, and particularly to an electrical connector providing good electrical and mechanical connecting and holding capabilities while also being inexpensive to manufacture.

Conventional set screw connectors generally provide a smooth, round bore surface for accepting and seating a conductor or cable inserted into the bore. Such structures tend not to provide extraordinary conductor holding ability, the set screw being the only item providing a biting action into the conductor to retain the same within the body of the connector.

In addition, in many prior set screw devices, when a set screw is moved against the conductor and the conductor against the contact surface of the connector in the process of effecting the connection, the material of the conductor tends to be extruded in opposed directions along the contact surface so that shear in the conductor in the direction of set screw travel is minimal. Hence, to assist in dislodging any dielectric oxidation on the conductor and the contacting surface of the connector body, and to improve somewhat the holding ability of the connector, protrusions or intrusions (indents or serrated surfaces) are sometimes provided on or in the contacting surfaces. Such protrusions or intrusions, however, add costs to the connector since they are generally provided by machining operations which are performed in addition to the basic process of making the connector body.

There is a group of connectors in which the above problems can be at least partially alleviated, these connectors involving the use of a base and keeper having leg or body portions interdigitally disposed, with aligned openings in such portions adapted to receive a conductor or cable to be connected by the device. In connecting a conductor, the base and keeper are moved in opposed directions against the conductor, the base and keeper providing multiple seats for engaging the conductor and for placing the conductor in shear. Such devices are shown in Swiss Pat. No. 419,275 and in Fotsch, Thomas, Locher and Hawkins U.S. Pat. Nos. 2,086,710; 2,112,053; 3,129,996 and 3,829,825, respectively. In the patent to Hawkins, the legs of a base and keeper are placed in tension against the conductor, the tension, and thus the connecting force being maintained by the resilient characteristics of the base and keeper, as explained in the patent, the base and keeper having both a transverse and longitudinal spring characteristic. (The embodiment of FIGS. 14 and 15 in the Hawkins patent is an exception to the tension principle disclosed in the patent.)

In these patents, two basic components (a separate base and keeper) are required. It can be appreciated that each item and each manufacturing step in making the item and assembling the connector involves costs that are reflected in the ultimate selling price of the connector and that any reduction in the number of components and manufacturing steps will produce a corresponding reduction in the costs of the connector. However, in making such reductions, it is necessary that the quality of connection not be also reduced, i.e., it is preferable that the holding ability of the connector be improved and it is necessary that any oxidation on the connector and on the conductor be dislodged in the connecting process to a degree and in amounts sufficient to provide a minimum or zero electrical resistance between the conductor and the connector body.

A single piece electrical connector is shown in British Pat. No. 1,295,391, the connector comprising a body made of bent sheet metal, the upper wall of the connector having overlapping wall portions. In FIG. 2 of the patent, the side and bottom walls of the body are deeply slotted to provide the same with a flexibility that is greater than the upper, overlapping wall of the connector, the bottom wall of the connector comprising only a narrow neck 9 of flexible material.

In U.S. Pat. No. 3,609,657, issued in the name of Harris I. Stanback, an electrical connector is shown employing two set screws located in a single connector body on opposed sides of the longitudinal axis of a cable received in the body, the two screws displacing the strands of the cable against the sides and bottom of the cable receiving bore of the connector body. In the connector of this patent, the connecting body and base surface have no windows or openings so that any shear of the cable is in directions normal to the travel of the set screws, in the manner explained above.

BRIEF SUMMARY OF THE INVENTION

The present invention is directed to a low cost, high quality electrical connector comprising a single piece metal body provided with an opening extending longitudinally therethrough and a relatively large diameter screw (in terms of the breadth of the metal body and having preferably a cone-shaped end) extending into the body in a direction perpendicular to the axis of the bore. A relatively small window or opening is provided in one or both sides of the body, which window intersects the longitudinal opening in the body tangential with or above the base line of the bottom wall of the body. The screw, when rotated into the metal body, compresses the electrical conductor or cable against the sides and bearing surfaces of the opening, which are rigid, and the portions of the body on each side of the opening are placed in tension. Further, shear is placed on the conductor in the direction of the travel of the screw as it compressibly displaces the material of the conductor laterally toward the space of the window to provide improved holding strength over previous connectors, as well as dislodging any dielectric oxidation that might be on the conductor and on the corners of the body surfaces engaging the conductor. The breadth of the screw, in cooperation with the conductor bearing against the base and side surfaces of the connector body, stops the travel of the screw. In this manner, the amount of shear and the amount of the material of the conductor that moves into the space of the window is limited, so that the conductor is not damaged or weakened. Further, the minimum amount of shear required to effect satisfactory electrical contact can be achieved by a low torque of the screw. Thus, the quality of the connection is not dependent upon the ability of a workman to apply a precise or large amount of torque to the screw.

THE DRAWINGS

The advantages and objectives of the invention will be better understood from consideration of the following detailed description when read in connection with the accompanying drawings in which FIGS. 1 and 2 are respectively side and end elevation views of a preferred embodiment of the connector of the invention;

PREFERRED EMBODIMENTS OF THE INVENTION

Figure 1:
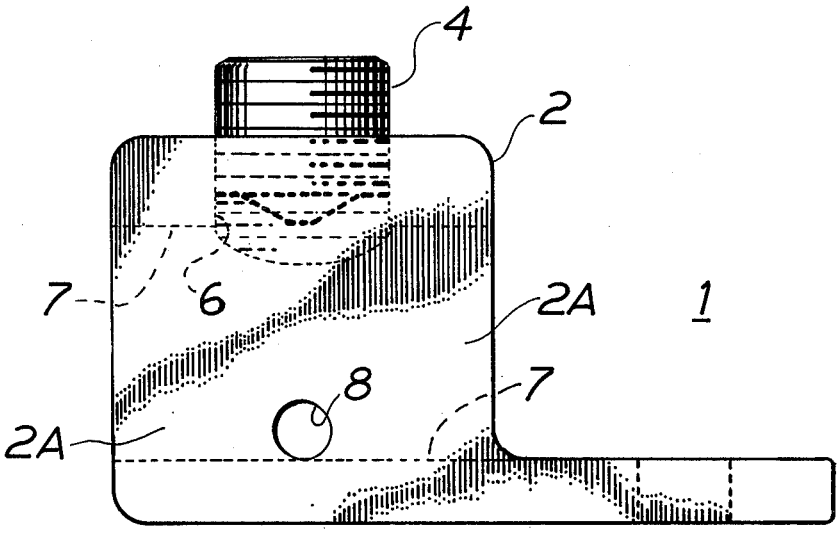
Figure 2:
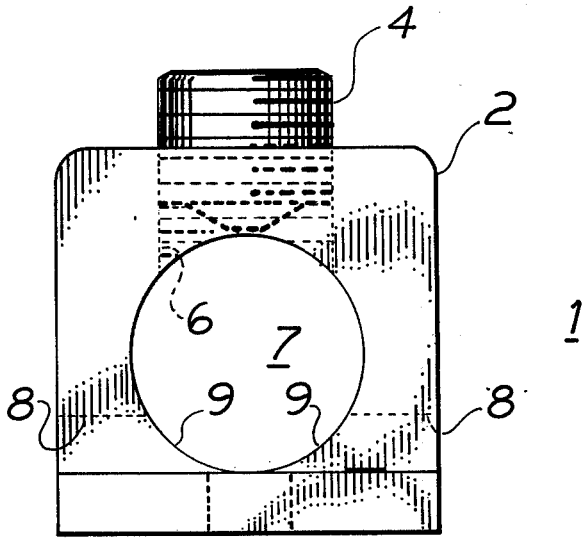

Referring now to the drawings, FIGS. 1 and 2 thereof show an electrical connector 1 comprised of a single piece, integral body 2 having a large diameter set screw 4 threaded into a tapped opening 6 provided in an upper wall of the body. Screw 4 is shown as a headless set screw for purposes of illustration, though other types of screws can be used without departing from the scope and spirit of the invention. An opening or bore 7 is provided in the body, and extends longitudinally through the body and at a right angle to the axis of tapped opening 6. The bore provides the body with solid upper and lower walls as well as opposed side walls integral with the upper and lower walls.

A lateral window opening or port 8 is provided preferably in both side walls of the body and extends into and intersects the lower portion of bore 7 of body 2. The port is shown intersecting bore 7 at right angles thereto, though the invention is not limited thereto. The window divides the side walls of the body into two portions 2A and provides two curved bearing surfaces 9 (FIG. 2) within opening 7, the bearing surfaces having relatively sharp corners for reasons explained hereinafter. As shown, the base of window 8 is tangential with the base line of bore 7 but can be completely above the base line, if desired.

Opening 8 can be provided by an extrusion process or by a simple drilling operation, an extrusion process allowing the shape of opening 8 to be other than the circular configuration depicted in FIG. 1.

When a bare conductor or cable (not shown) or an insulated conductor or cable having a bare end is inserted longitudinally into opening 7 of the connector, set screw 4 is turned to translate the same into opening 7 through tapped opening 6 against the upper periphery or surface of the conductor. The turning of the screw continues until a controlled increase in torque is attained. This occurs when a predetermined installation torque is resisted by the conductor. When the forward motion (downward motion in FIGS. 1 and 2) is stopped, the strands are pressed downwardly against the bottom surface of bore 7 and side surfaces 9 (FIG. 2) of connector body 2 and against the window opening 8, the walls of body 2 being substantially rigid. When the forward motion of the set screw is stopped, a controlled amount of shearing of the conductor has taken place as well as a forceful securance of the conductor within the connector body. Shearing is accomplished when the material of the conductor engages the rigid bottom wall of the connector body and surfaces 9 and is then forced toward windows 8 and against the relatively sharp corners of the connector body provided by 8, the amount of shear being controlled by the limited diameter of the window and limited amount of torque.

The window opening acts to firmly engage the conductor in the connector body such that a $\frac{1}{3}$ more mechanical holding ability is provided over prior, smooth bore connectors. Mechanical testing of the two types of connectors has demonstrated this superior holding ability of the connector of the invention. The testing involved the application of pulling forces on the conductors held in fixed connector bodies and then measuring the forces required to pull conductors from the connector bodies. The rigid structure of the connector body of the invention coupled with edges of a window opening provided therein maintained firm, mutual engagement of the conductor and body that resisted release of the conductor. In addition, the window provides good holding ability during the occurrence of any mechanical vibration or changes in ambient or operating temperature of the connector and conductor.

In using a medium to high strength aluminum alloy for a connector body of the type shown in FIGS. 1 and 2, with the body having a width of 0.87 inch, a height of 1.05 inches and a diameter of 0.593 inch for longitudinal opening 7, an appropriate size for window opening 8 is about a 0.219 inch diameter. An appropriate diameter for the set screw is 0.562 inch, while the thickness of the base wall is 0.228 inch and the minimum thickness of each side wall (about opening 8) is 0.141 inch. Such dimensions provide a relatively small connector body with sufficiently rigid characteristics for good securance of a conductor, and are economically provided by extrusion processes, though the invention is not limited thereto.

Figure 3:
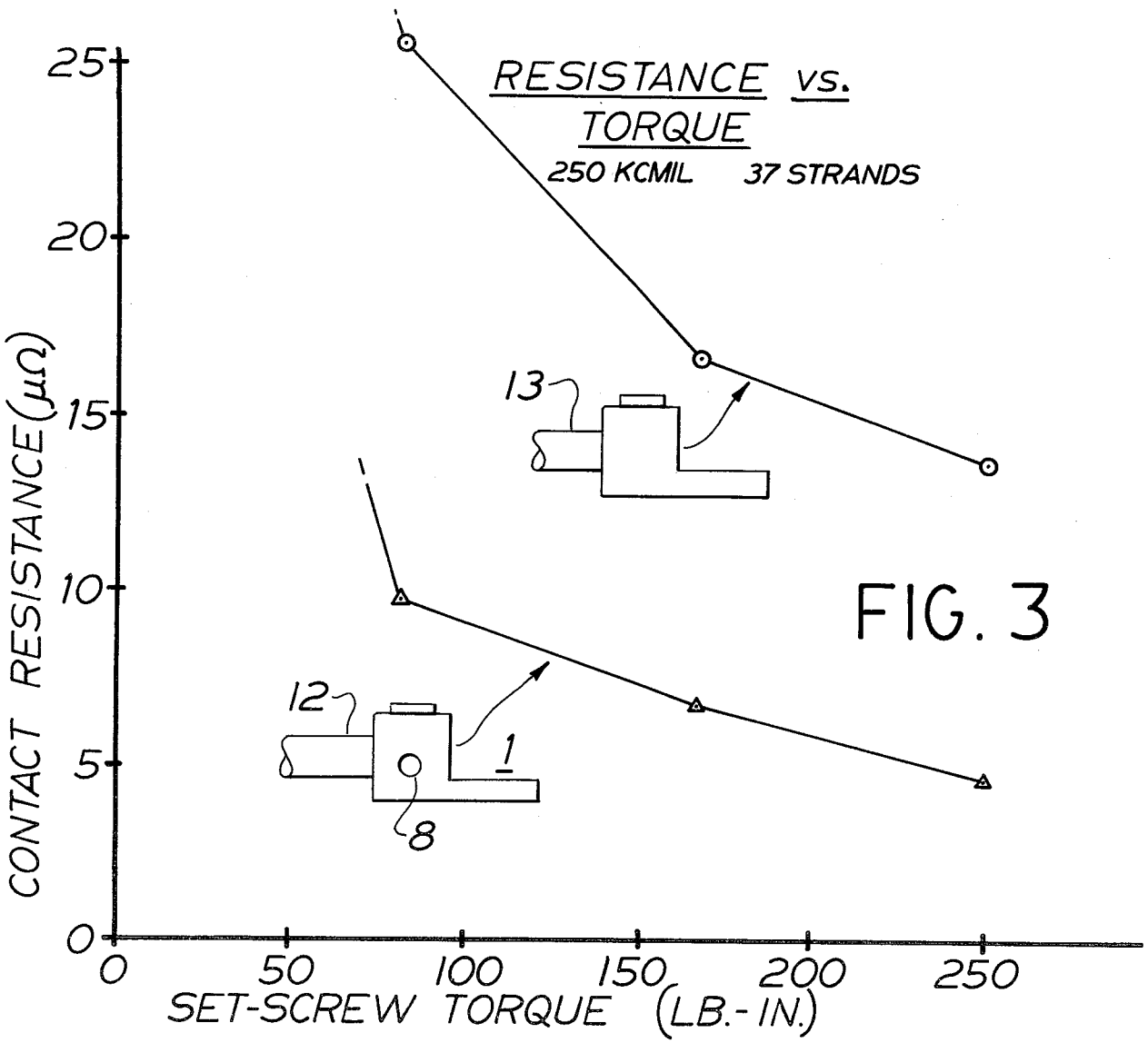
FIG. 3 is a plot of electrical resistance measurements versus applied torques of a set screw in comparing the connector of the invention with a conventional connector.

The improved electrical capabilities of the present connector are indicated by the graphs of FIGS. 3 through 6. Electrical tests were made, and resulting data collected, on connectors of the present invention and conventional connectors, both having the above dimensions, the conventional connectors, however, having no window in either side thereof. The tests determined resistance (in micro ohms) to current flow between the contacting surfaces of the connectors and cables or conductors 12 and 13 (FIG. 3) secured in the connectors by their respective set screws. As indicated in FIG. 3, the test conductors were secured in the test connectors by the use of three different torque forces (83, 167 and 250 pounds-inch) applied to the set screws so that the electrical resistance measurements were made at these torques. As clearly evident in FIG. 3, the contact resistance of the connectors of the present invention was substantially less and substantially more uniform than the connectors without the side openings or ports. The uniformity of the resistance of the connectors of the present invention demonstrates that the quality of the electrical connection effected is not significantly dependent upon the ability of personnel to apply precise amounts of torque to the connecting screw.

Figure 4:
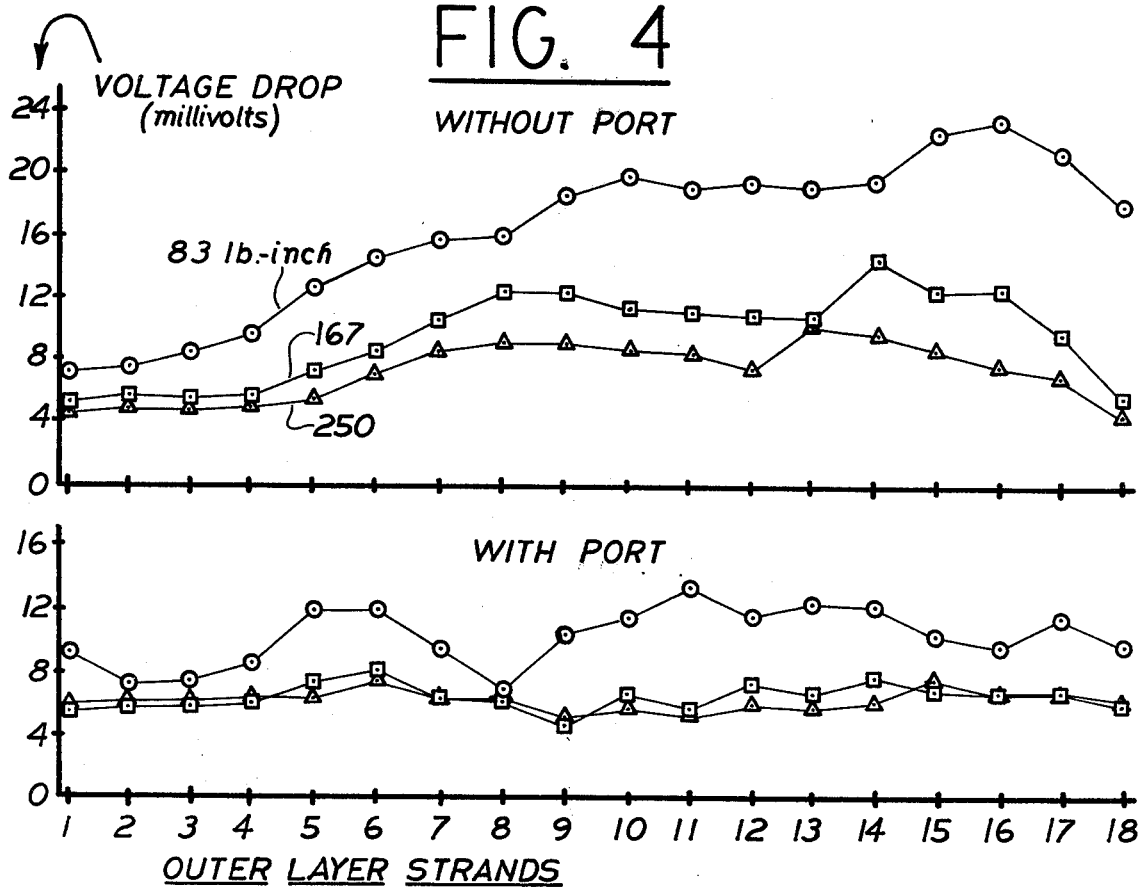
FIGS. 4 to 6 are plots of the voltage drop across each strand of a stranded conductor and an associated connector comparing the connector of the invention with a conventional connector.
Figure 5:
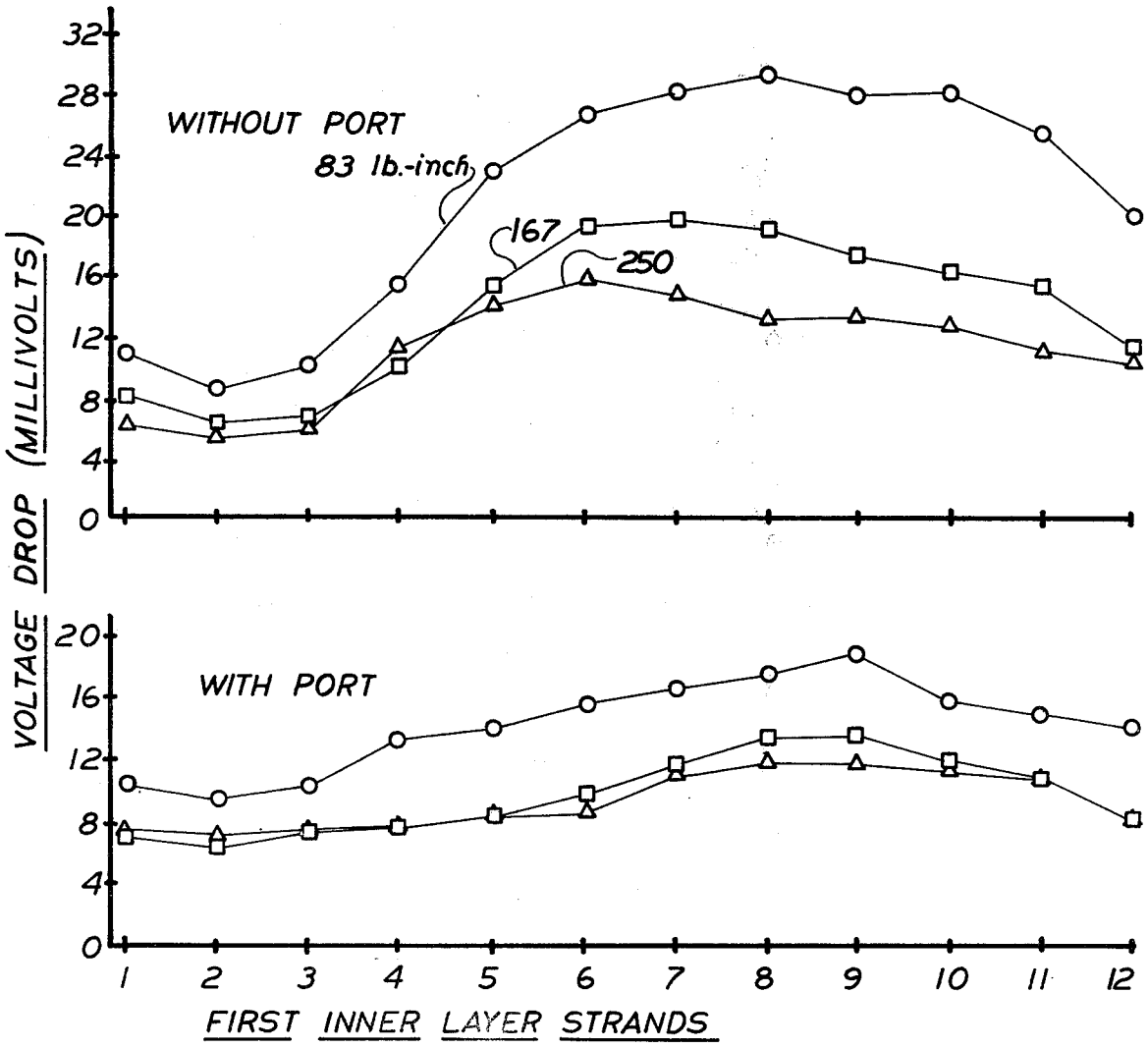
Figure 6:
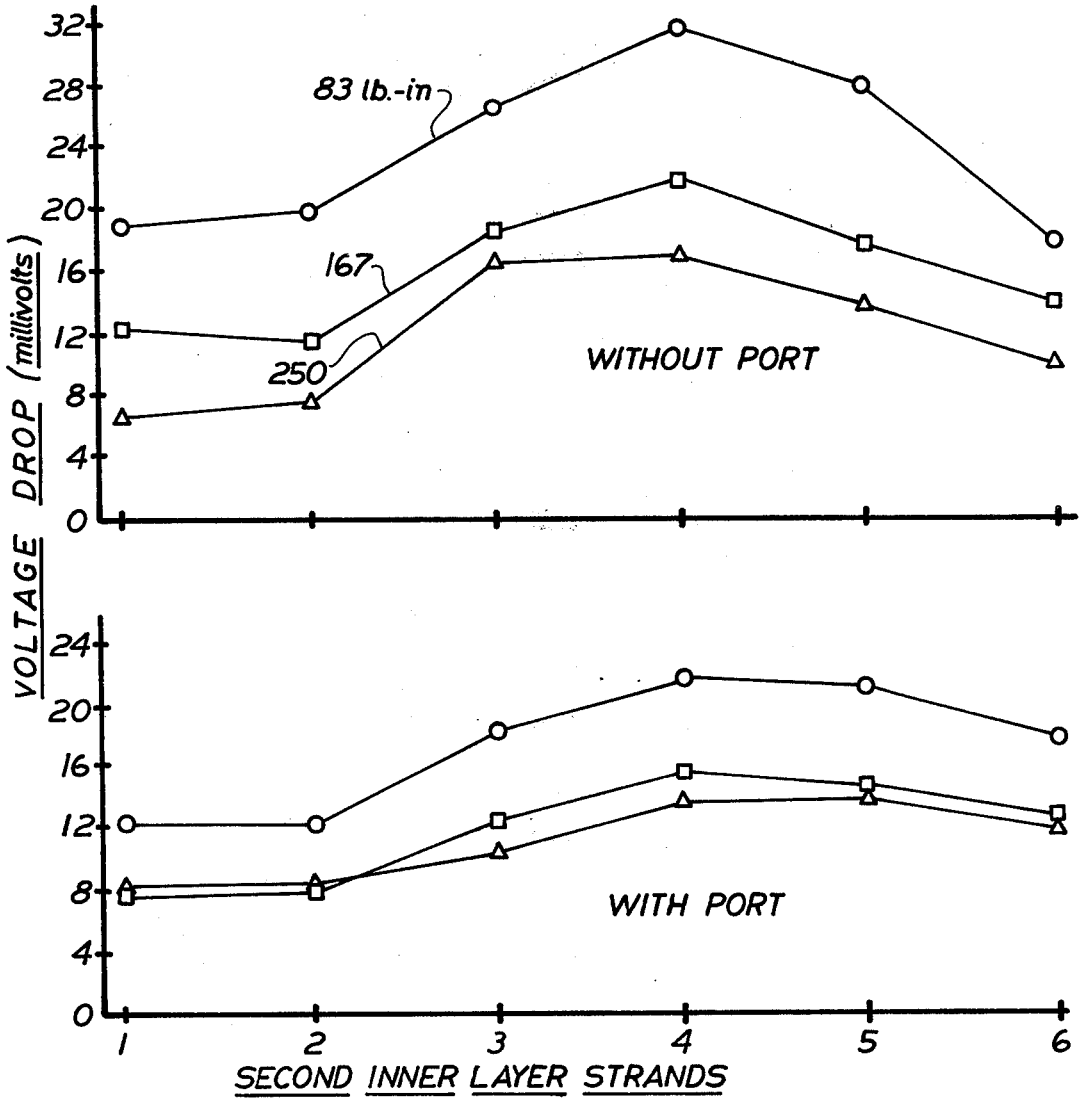

As indicated in FIGS. 4 to 6, additional tests were conducted on the above types of connectors to determine the voltage drop between the connectors and individual wires or strands of the test conductors 12 and 13, the type of conductor employed in the tests being a 250 kcmil compact conductor having 37 strands helically wound in the same direction. Eighteen of the 37 strands, in such a conductor, form an outer layer, 12 of the strands form a layer immediately beneath the outer layer, with six of the remaining seven strands providing a third layer near the center of each conductor. The alloy and temper of the test conductors was CS49-H221.

In FIG. 4, numbers 1 to 18, along the abscissa of the graph, designate the 18 wires of the outer layer of each conductor, with wire number one (1) being directly under or immediately adjacent the end of set screw 4 (with wire 18 immediately adjacent an opposed surface of 4). Similarly, numbers 1 to 12 and 1 to 6 along the respective abscissas in FIGS. 5 and 6 are the inner wires of each test conductor.

The ordinates of these graphs designate voltage drop values in millivolts across the test connectors of the two test groups (with and without opening 8) and each strand of the test conductors, using a measuring (DC) current of 10 amperes. The current was simultaneously directed through the strands of the test conductors (and the test connectors) while voltage differences were measured between the free end of each strand in the test connector and the body of each test connector. These voltage differences (or drops) were measured under the three torque conditions described above in connection with the tests of FIG. 3 (83, 167 and 250 pounds-inch), the individual measurements being designated in FIGS. 4 to 6 by circles, squares or triangles, with the circles representing 83 pounds-inch, the squares representing 167 pounds-inch, and the triangles representing 250 pounds-inch of torque.

As clearly seen in the plots of FIGS. 4 to 6, the voltage drops of the individual strands secured in the connectors of the invention were substantially lower and substantially more uniform than those of the connectors without side ports 8, i.e., with the connector of the invention, current distribution tends to even out among all of the strands of the conductor, thereby providing improved connector performance as localized heating due to concentrations of current flow in limited portions of the conductor cross section is avoided.

Set screw 4 preferably has a conical shape end portion for engaging an associated conductor, as shown, though a round end can be used. The conical end prevents excessive concentration of compressive forces on the conductor by entering between and dividing the strands of the conductor so that the strands tend to ride up the cone surface of the set screw. A suitable tool, such as an Allen wrench, can be used to torque the set screw against and into the conductor.

While the invention has been described in terms of preferred embodiments, the claim appended hereto is intended to encompass all embodiments which fall within the spirit of the invention.

Having thus described our invention and certain embodiments thereof, we claim:

1. A rigid electrical connector comprising a structurally rigid, single piece metal body having an opening extending longitudinally therethrough for receiving a bare portion of a cable or conductor longitudinally inserted therein, and providing opposed, structurally rigid side walls and a solid, rigid, continuous, structural base wall and surface for seating and engaging a substantial portion of the breadth of the cable or conductor, a lateral window provided in at least one side wall of the metal body and intersecting the longitudinally extending opening, the size of the lateral window being such that the rigidity of the metal body is substantially unaffected by the window, screw means extending into the metal body from a direction generally opposite the base surface and perpendicular to the axis of the longitudinal opening, the screw means being effective to compressibly engage and force a conductor inserted into the longitudinal opening against the rigid base surface and lateral window in a manner that moves conductor material into the window and into contact with the material of the metal body around the window to shear any oxides on the conductor and to provide improved resistance to pull-out of the conductor from the metal body.

* * * * *